US005300819A

United States Patent [19]

Lee

[11] Patent Number: 5,300,819

[45] Date of Patent: Apr. 5, 1994

[54] AUTOMATIC POWER REGULATOR FOR INDUCTION TYPE BIOGAS GENERATOR

[75] Inventor: Ching-Ping Lee, Hsinchu, Taiwan

[73] Assignee: Industrial Technology Research Institute, Hsinchu, Taiwan

[21] Appl. No.: 856,478

[22] Filed: Mar. 24, 1992

[51] Int. Cl.[5] ..... F02G 3/00

[52] U.S. Cl. ..... 307/47; 123/357; 123/358; 123/359; 123/3

[58] Field of Search ..... 307/52, 57, 68, 47, 307/84; 290/40 R, 40 A, 1 R; 123/357, 358, 359, 3, 350

[56] References Cited

U.S. PATENT DOCUMENTS 4,211,932 7/1980 Geary, Jr. ..... 290/52
4,262,209 4/1981 Berner ..... 290/7
4,773,370 9/1988 Koshizawa et al. ..... 123/357

*Primary Examiner*—A. D. Pellinen
*Assistant Examiner*—Aditya Krishnan
*Attorney, Agent, or Firm*—Fish & Richardson

[57] ABSTRACT

Disclosed is an automatic power regulator for controlling an induction type biogas generator via an electrically controlled governor. The biogas generator is directly coupled with a commercial AC power network. The regulator controls the power output of the generator to follow the power consumption of a load according to the difference between the power output and the power consumption. Positive and negative references are set to avoid oscillation of the system.

2 Claims, 7 Drawing Sheets

AUTOMATIC POWER REGULATOR FOR INDUCTION TYPE BIOGAS GENERATOR

FIELD OF THE INVENTION

The present invention relates to an automatic power regulator, especially to an automatic power regulator for an induction generator using a biogas engine as the power source.

BACKGROUND OF THE INVENTION

The excrement and urine from pigs are highly-contaminated wastes. As environmental preservation has become more and more important, waste treatment equipments are essential to pig raisers. By fermentation treatment, a great amount of flammable biogas is produced in the treatment process. After collecting and storing, the biogas can be brought into use as a fuel for furnaces or internal combustion engines by pig raisers for a long period of time. But, due to various inconveniences, biogas has not been broadly used in electric power generators in Taiwan. Since power resources are rare in Taiwan, especially in summer, electric power is in short supplying. On the other hand, in the summer, biogas is produced at a maximum rate (the higher the temperature, the more biogas produced). Nevertheless, biogas has not been put into full use. the more biogas produced). Nevertheless, biogas has not been put into full use.

The biogas generator commonly used in Taiwan is usually a synchronous AC generator driven by a gas engine. The generator directly supplies its load. The load is mostly inductive loads (e.g. motors). This kind of load demands 3 to 5 times the rated power, i.e. the inrush power, when it starts. For supplying such a power demand, the maximum power capacity of the biogas generator is designed to exceed the need. Consequently, the cost of capital equipments is greatly raised as the power capacity increases. Furthermore, the gas consumption and the operating cost are relatively high, due to the mismatch of the power capacity and the ordinary power demand. Besides the above mentioned shortcomings, some of the major parts are expensive including the governor and the synchronous AC generator. Summing up the above, the problems that arise in biogas power generation are briefly described as follows:

(1) There are few kinds of commercial power generators designed for biogas. The power modules now in use are normally assembled by parts of different machines. These parts are not easily available, and are difficult to operate and repair.

(2) The power capacity of the generator must be much larger than the load. But the yield of biogas is decided by the number of pigs. Therefore the capital cost is high, due to high power capacity, and operating time is short, due to high gas consumption.

(3) It is difficult to connect the generators in parallel. For a user having more than one generator, an optimized operating condition can not be achieved easily.

(4) Difficult to start and stop is another problem. The engine is started by a starting motor and batteries. Only experienced personnel can do the switching and control the AC frequency.

SUMMARY OF THE INVENTION

It is therefore an object of this invention to provide a power regulator for automatically controlling the induction type biogas generator.

The power regulator according to the present invention is featured in a power controller which controls the amount of biogas intake according to the difference between the power output of biogas generator and the power consumption of load. Therefore less electricity is supplied by or fed into the commercial AC power network.

The object of the present invention is accomplished by providing an automatic power regulator parallelly coupled with a commercial AC power network, which controls the power output of an induction type generator via an electrically controlled governor of the generator according to the power output of the generator and the power consumption of a load, comprising: a power detector for detecting the difference between the power output of the generator and the power consumption of the load and outputting a signal indicating the difference; means for comparing said indicating signal with predetermined positive and negative references, said comparing means being capable of outputting a positive driving signal when said indicating signal is greater than the positive reference, and outputting a negative driving signal when said indicating signal is smaller than the negative reference; and controlling means coupled between said comparing means and the governor, being capable of driving the governor according to said positive driving signal and said negative driving signal.

The further scope of applicability of the present invention will become apparent from the detailed description given hereinafter. However, it should be understood that the detailed description and specific examples described herein, while indicating preferred embodiments of the invention, are given by way of illustration only, since various changes and modifications within the spirit and scope of the invention will become apparent to those skilled in the art from this detailed description.

BRIEF DESCRIPTION OF THE FIGURES

The present invention will become more fully understood from the detailed description given hereinbelow and the accompanying drawings which are given by way of illustration only, and thus are not limitative of the present invention and wherein.

DETAILED DESCRIPTION OF PREFERRED EMBODIMENT

Figure 1:
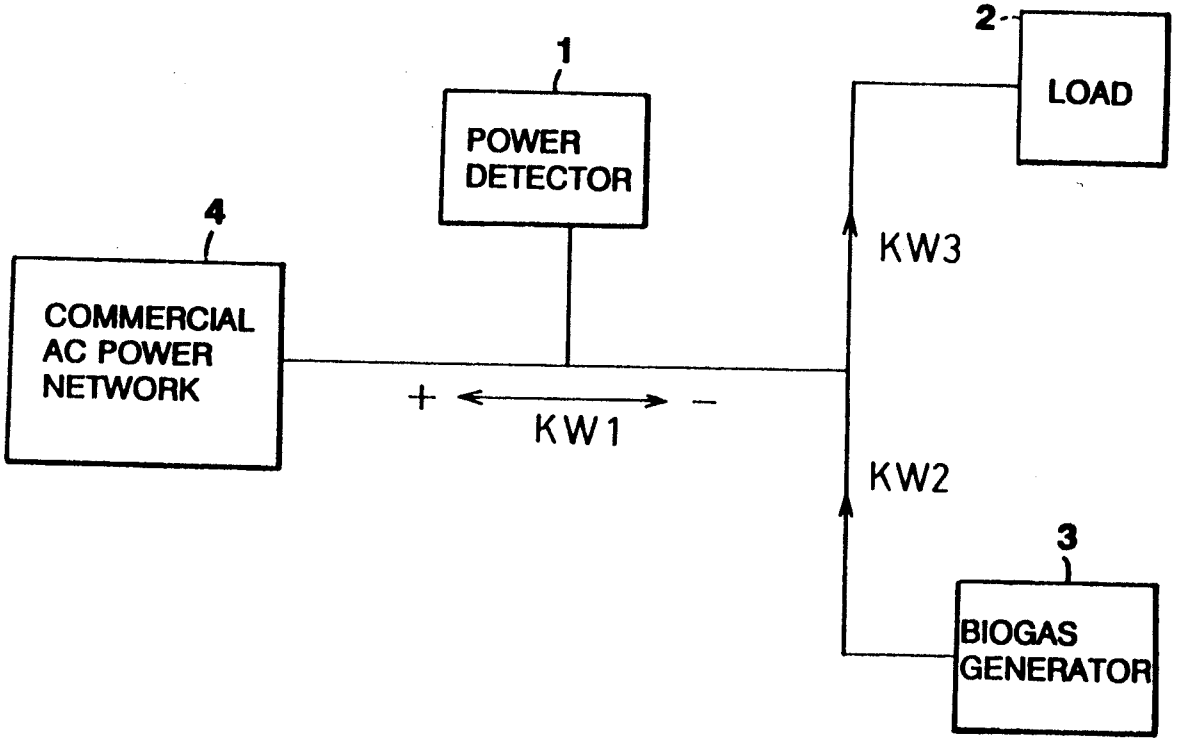
FIG. 1 shows how the commercial AC power network and the biogas generator supply the load.

Referring to FIG. 1, the effective power of the commercial AC power network (KW1) is determined by the difference between the power output of the biogas generator (KW2) and the power consumption of load (KW3), i.e. KW1=KW2−KW3. When KW2 is greater than KW3, the power output of the biogas generator will be fed into the commercial AC power network. When KW2 is smaller than KW3, the power output of the biogas generator is not able to supply the load, therefore a part of the power consumption of the load is supplied by the commercial AC power network. As a conclusion, the ideal condition is KW2=KW3, while KW1=KW2−KW3=0. In other words, no effective power is supplied by or fed into the commercial AC power network. At this time, the power output of the biogas generator just supplies the load, so as to save energy.

In ordinary operation, the power consumption of the load varies frequently. It is difficult for a person to monitor the variation of the load and to control the power output of the biogas generator to follow the variation of the load. Consequently, the present invention is provided with a power detector to detect the value of KW1. An electrically controlled valve is driven by a controlling circuit according to the value of KW1, thereby controlling the power output of the biogas engine and the biogas generator.

Figure 2:
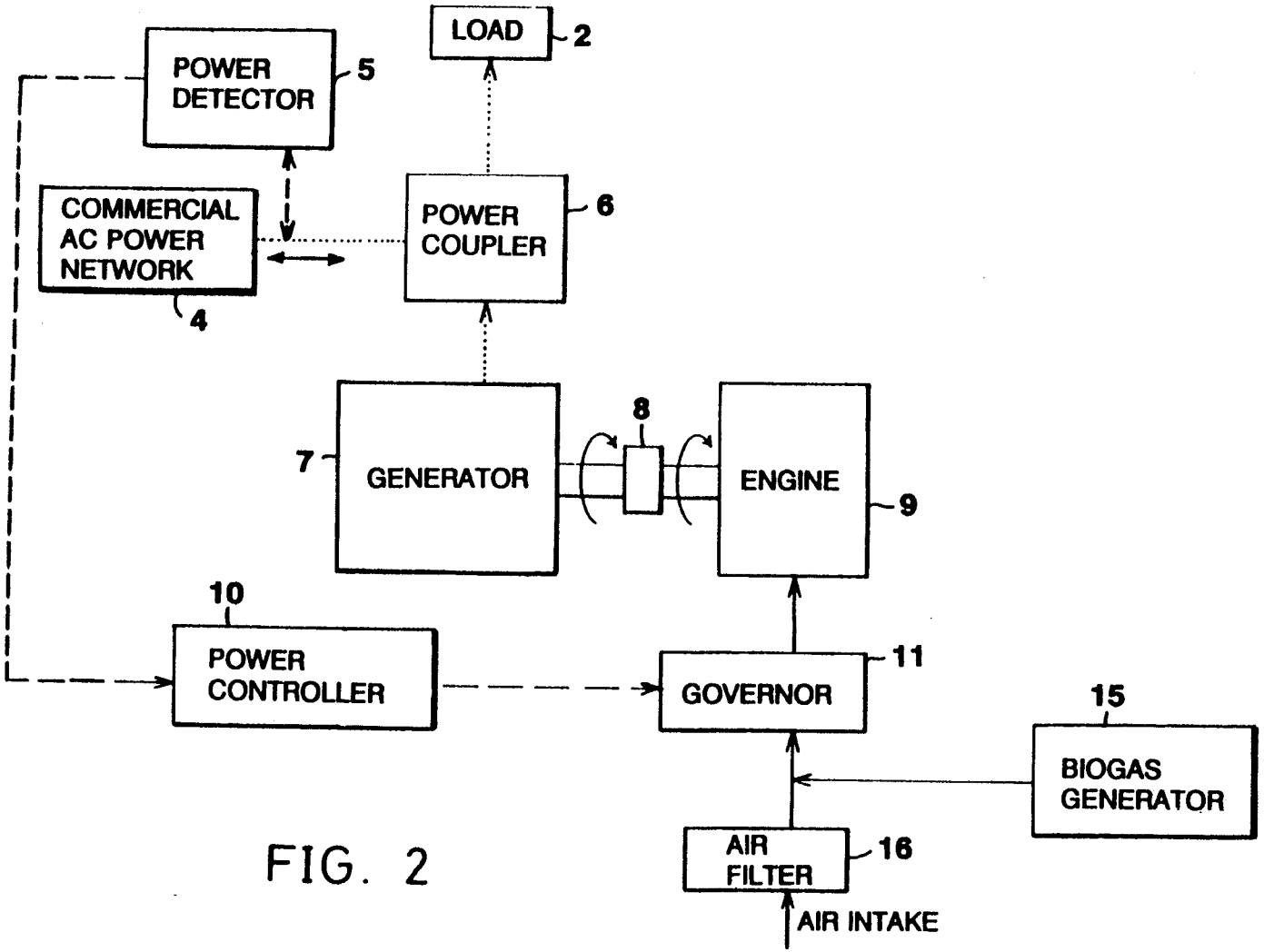
FIG. 2 shows the schematic block diagram of the system of the present invention.

FIG. 2 shows the system block diagram of the induction-type biogas generator according to the present invention, wherein solid lines represent pipes of the biogas, dotted lines represent power cables, and phantom lines represent control circuits of a controller. The working principles are discussed hereinbelow.

Air is sucked into air filter 16 and mixed with biogas 15. After passing through governor 11, the mixture of air and the biogas enters engine 9 and burns therein to operate engine 9. The output shaft of engine 9 is connected with the input shaft of generator 7 by coupler 8. Therefore, engine 9 directly drives generator 7. The power output of generator 7 is electrically coupled with commercial AC power network 4 by a coupler 6 and then fed into load 2, for supplying the power consumption of load 2. During operation of generator 7, the value of KW1 is detected by a power detector 5, and then sent to a power controller 10. Power controller 10 compares the value of KW1 with predetermined values of a positive reference value (when KW1 is positive) and a negative reference value (when KW1 is negative), for determining whether to adjust governor 11 or not. Power controller 10 adjusts governor 11 for controlling the power output of engine 9 and the power output of generator 7.

The generator 7 is an induction generator. The exciting current of the generator comes from the commercial AC power network 4. Therefore the voltage, the frequency, and the phase that generated by generator 7 are equal to those of the commercial AC power network 4. Hence, generator 7 can be directly coupled to the commercial AC power network 4 by coupler 6. The coupler 6 is a conventional coupler for directly coupling generator 7 and the commercial AC power network 4.

It should be noted that the air filter 16, the biogas 15, the engine 9, the coupler 8, the commercial AC power network 4, and the load 2 are all conventional, and they will not be further discussed in the specification.

Power detector 5 is a conventional device which is utilized to detect the effective power of the commercial AC power network, KW1. Conventional digital electric power transducer can be utilized to convert the value of KW1 into a linear voltage signal for sending into the power controller 10 as input. However, in this embodiment, in order to further reduce the cost, a conventional electric power transducer having a current signal output is used for detecting the value of KW1. The current signal is converted into the linear voltage signal in the power controller 10. A hand-type indicator is provided to indicate the value of KW1.

The major part which constructs the present invention "Automatic Power Regulator" including the power controller 10 will be further discussed hereinbelow.

Figure 3:
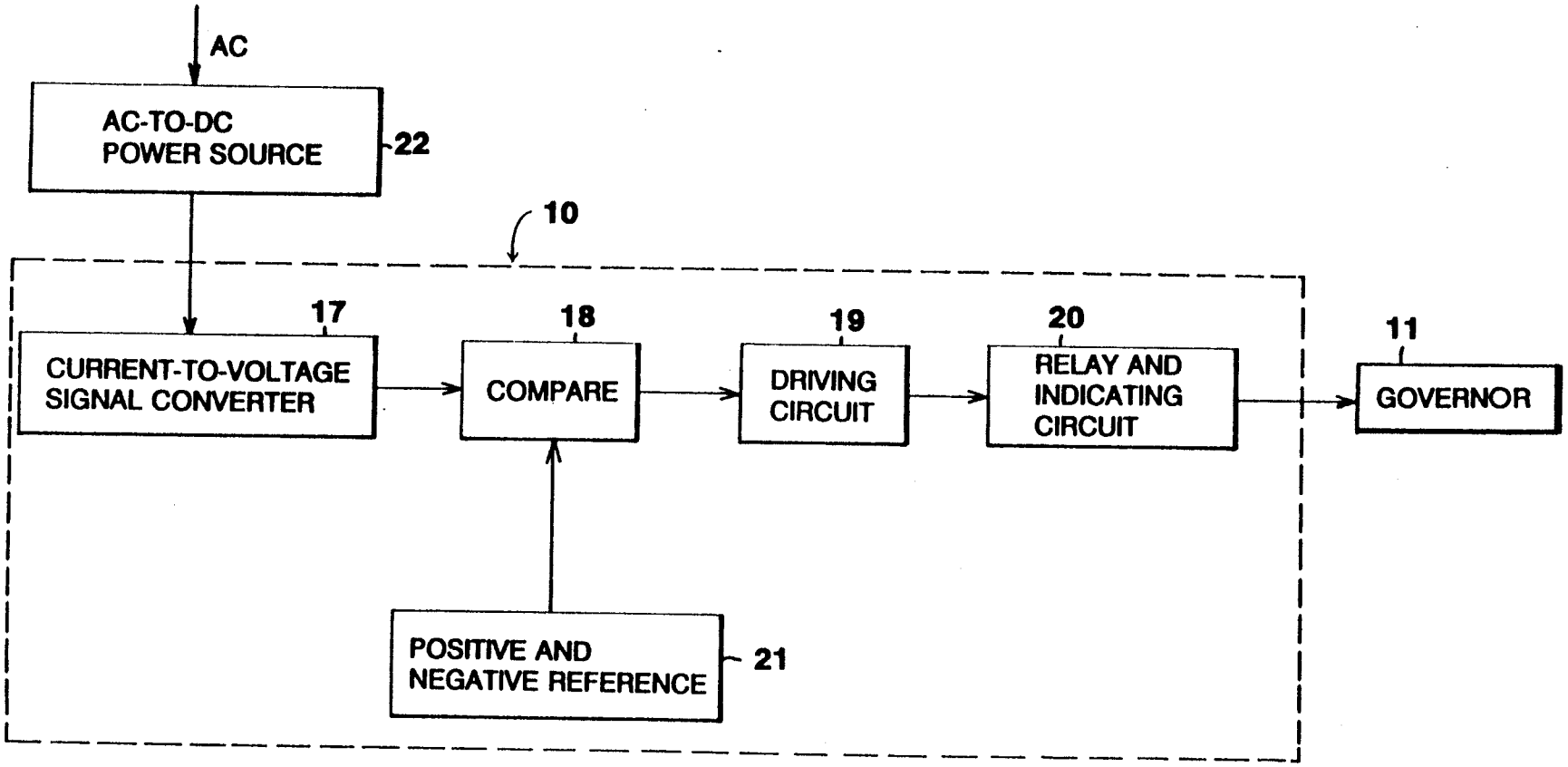
FIG. 3 shows the functional block diagram of the power regulator of the present invention.
Figure 4:
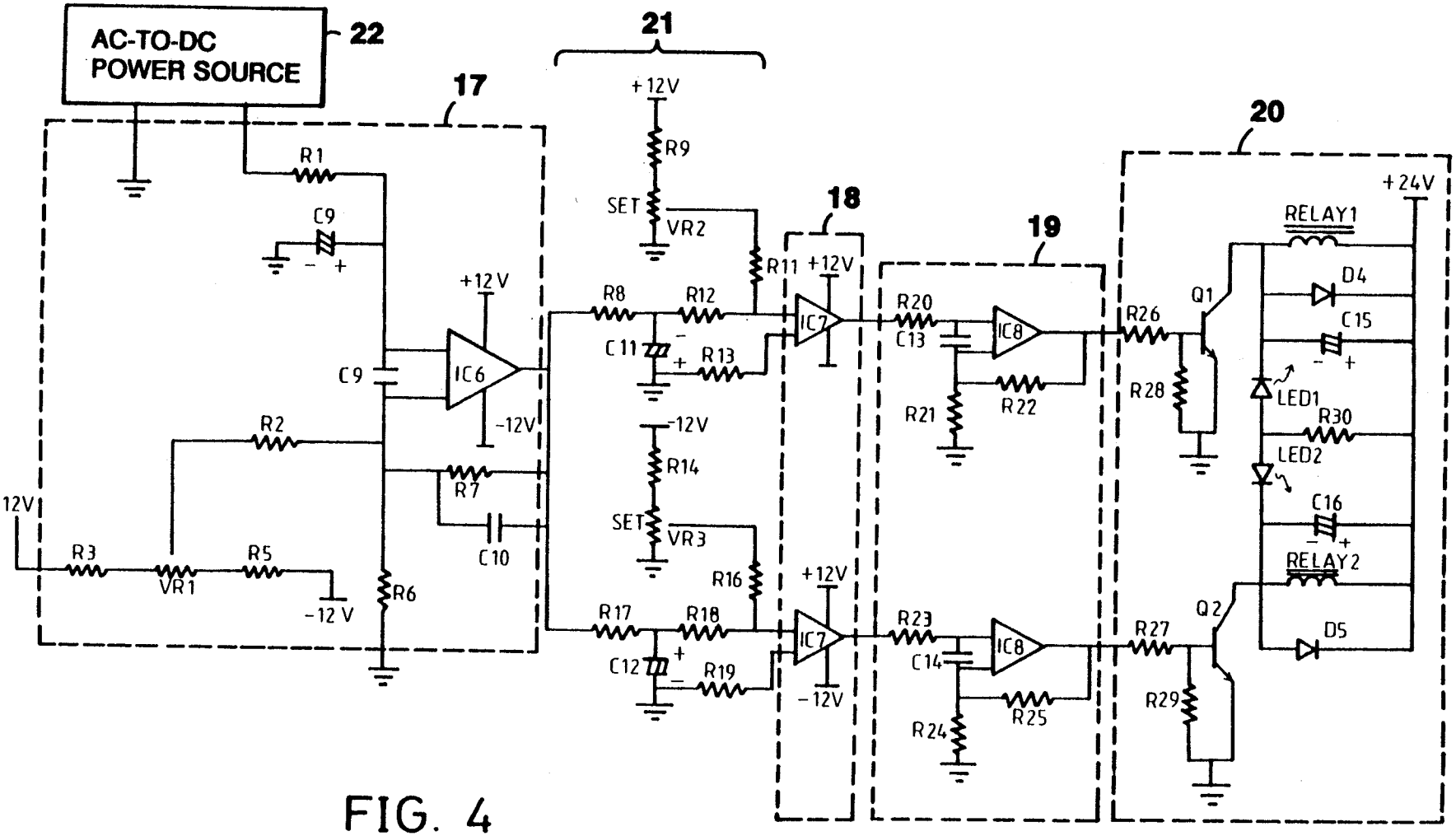
FIG. 4 shows the circuit diagram of the power regulator of the present invention.
Figure 5:
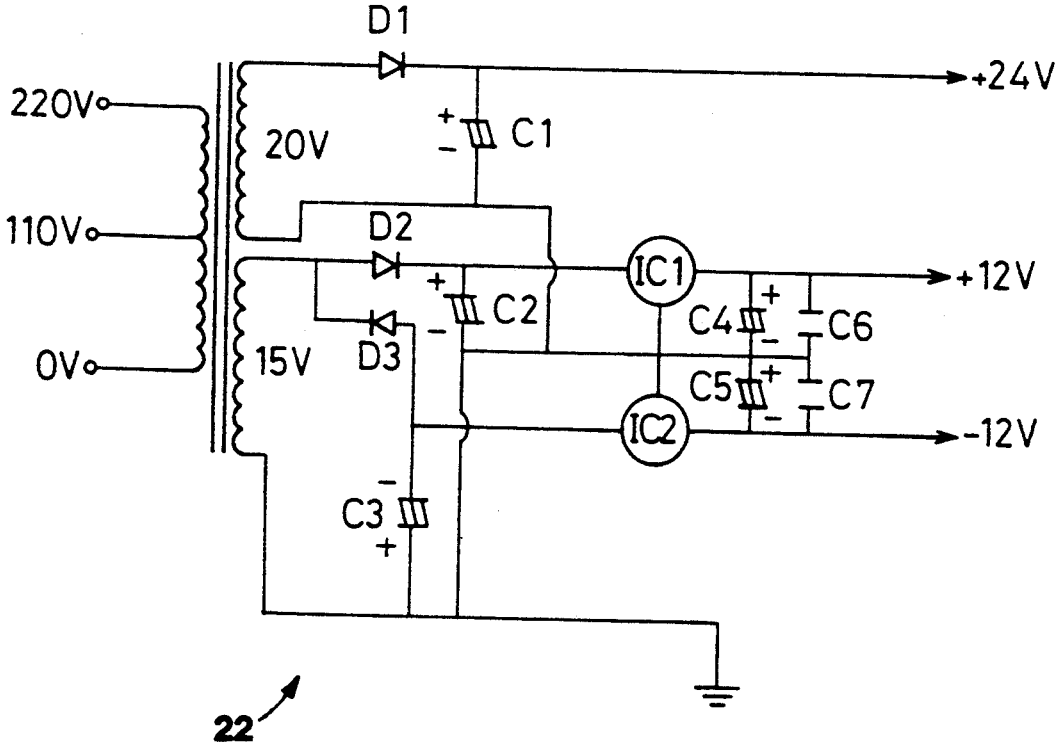
FIG. 5 shows the circuit diagram of the power supply of the present invention.

The block diagram and the circuit diagram of the power controller 10 are shown respectively in FIGS. 3 and 4. The power controller 10 includes a power source circuit 22, a current to voltage signal converting circuit 17, a comparing circuit 18, a positive and negative references set-up circuit 21, a driving circuit 19, and a relay and indicating circuit 20, which are disclosed as follows:

1) power circuit 22. As shown in FIG. 5, power circuit 22 provides a constant DC power source for supplying the elements of the power controller 10. The voltage of the commercial AC power is reduced by a transformer. The AC power is then rectified filtered by a voltage regulating circuit constructed by voltage regulation IC1, voltage regulation IC2, D1, D2, D3, C1, C2, C3, C4, C5, C6, and C7, for providing the constant DC power source at $+24^{vcc}$, $+12^{vcc}$, $-12^{vcc}$, and $0^{vcc}$ respectively.

2) The current to voltage signal converting circuit 17 determines the sign of the current signal, and converts the current signal into the linear voltage signal. As shown in FIG. 4, circuit 17 is constructed by operational amplifier IC6, R1, R2, R3, R5, R6, R7, C8, C9, C10, and VR1. VR1 is utilized to adjust an offset voltage. The linear voltage signal is output from IC6.

3) The comparing circuit 18 is constructed by two adder-subtractors. The adder-subtractors are principally composed of operation amplifier IC7. IC7 contains two operation amplifier ICs which compares the linear voltage signal with the positive and negative references and converts the results into logic signals respectively.

4) The positive and negative references set-up circuit 21 provides references for the comparing circuit 18 to compare. The absolute values of the references must be greater than zero in order to avoid oscillation. The reason is that either a positive driving logic signal or a negative driving logic signal is true when the positive and negative references are both zero, so the driving circuit 19 always drives the governor 11 either in a positive direction or a negative direction, so that the governor 11 is always oscillating. The set-up circuit 21 is constructed by two variable resistor VR2 and VR3. When the linear voltage signal is positive and is greater than the positive reference, then the governor is positively driven to reduce the amount of biogas intake in order to reduce the power outputs of engine 9 and generator 7. On the other hand, when the linear voltage signal is negative and is smaller than the negative reference, then the governor 11 is negatively driven to increase the amount of biogas intake in order to increase the power outputs of engine 9 and generator 7. When the linear voltage signal is greater than the negative reference and is smaller than the positive reference, the governor 11 is not driven. The references are set so that the difference between the positive and negative references corresponds to 1/10 of the total power output capacity, preferably, so as to achieve a stable and economic operation.

5) The driving circuit 19 amplifies the logic signal which comes from the comparing circuit 18 in order to drive power transistors of the relay and indicating circuit 20. The driving circuit 19 is principally constructed by IC8 which contains two operational amplifiers.

6) The relay and indicating circuit 20 receives the driving signals from the driving circuit 19 and drives relays and indicating LEDs which indicates the operating condition. Circuit 20 is principally constructed by two power transistors Q1 and Q2, RELAY1, and RELAY2. D4 and D5 are utilized to absorb the induction energy of RELAY1 and RELAY2. LED1 and LED2 are utilized to indicate the state of the power transistors and the relays for monitoring. The relays are serially coupled with power sources of the motor of the governor 11. When one of the logic signal which means "positive driving" is set true, one corresponding relay is set to "ON" to positively drive the governor 11. When another logic signal which means "negative driving" is set true, another relay is set to "ON" to negatively drive the governor 11. When both logic signals are false, no relay is set to "ON" and the governor maintains its situation.

Figure 6:
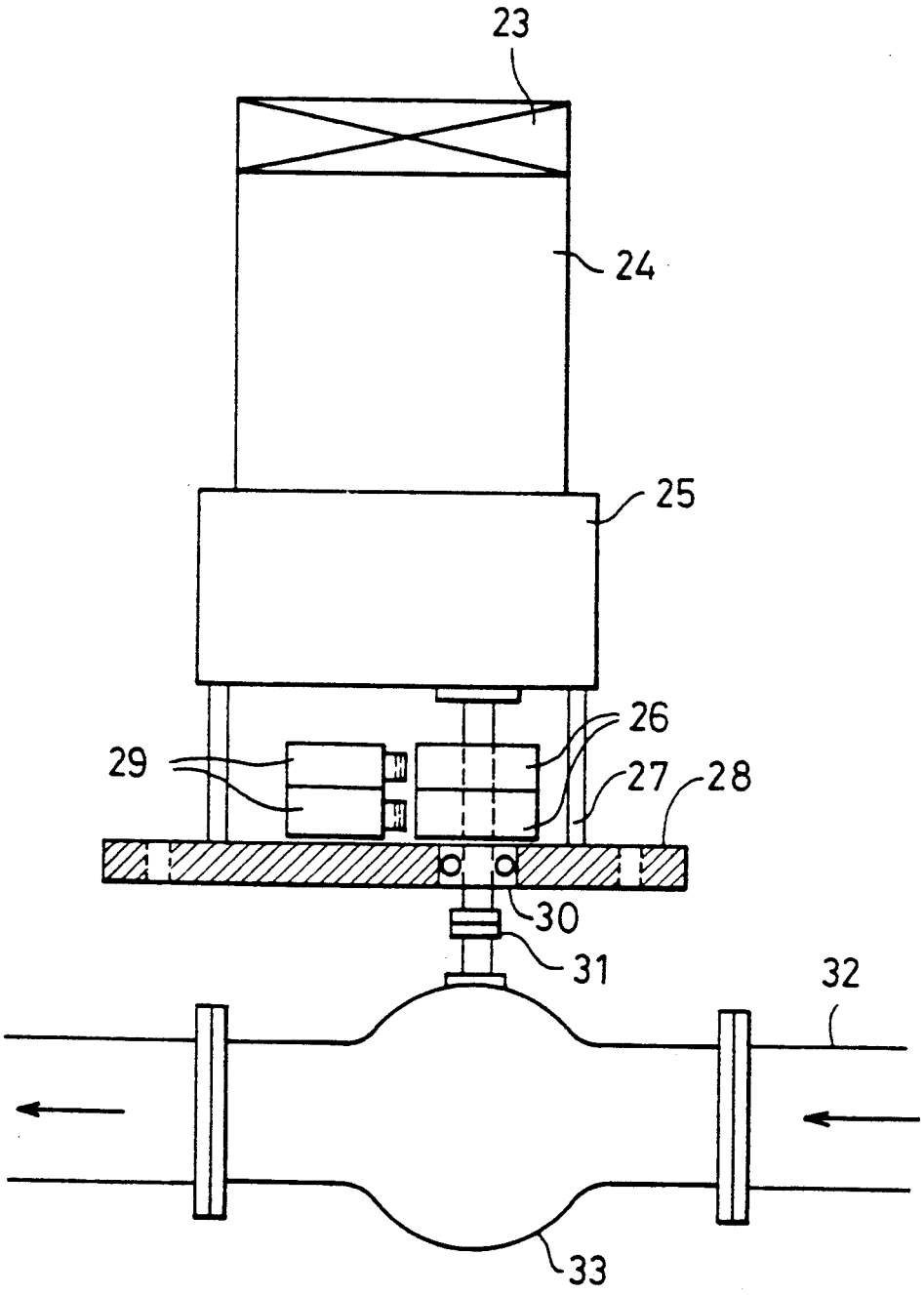
FIG. 6 shows the schematic diagram of the governor.

FIG. 6 shows the schematic diagram of the governor 11. Governor 11 contains an AC induction motor 24 which directly drives a reduction gear box 25. Motor 24 is supported to a plate 28 by supporting means 27. The output shaft 23 of gear box 25 is supported by a bearing 30 and connected to a disk type valve 33 via a coupler 31. Disk type valve 33 controls the biogas flow in gas pipe 32.

In operation, when the load decreases, the power output of the generator 7 gradually becomes greater than the power consumption of the load. If their difference is larger than the predetermined value corresponding to the positive reference, the power controller 10 will positively drive the governor 11 to reduce the power output of the generator 7, until the difference is less than the predetermined value. On the other hand, when the load increases, the power output of the generator 7 gradually becomes smaller than the power consumption of the load. If their difference is larger than the predetermined value corresponding to the negative reference, the power controller 10 will negatively drive the governor 11 to increase the power output of the generator 7, until the difference is less than the predetermined value. Therefore, the difference between the power output of the generator 7 and the power consumption of the load is kept in a range between the corresponding values of the positive and of the negative references.

Two cams 26 are fixed on the shaft 23. Two corresponding limit switches 29 are fixed on the plate 28. Cams 26 rotate with shaft 23. When the valve 33 is rotated to a fully open position or to an idle position, limit switches 29 will be triggered by cams 26 to shut off the power of motor 24, so as to insure that the valve 33 rotates between these two positions. Valve 33 is not fully closed at the idle position because the engine needs a little gas when idling.

The governor is a conventional device which is broadly used. The governor stated above is one of the commercial available governors. Other types of governors can also be utilized in the present invention.

It should also be noted that the fuel of the engine 9 is not limited only to biogas. Other fuels like methane, natural gas, petroleum gas, gasoline, etc. can also be used if the engine is adequately selected to fit it.

Figure 7:
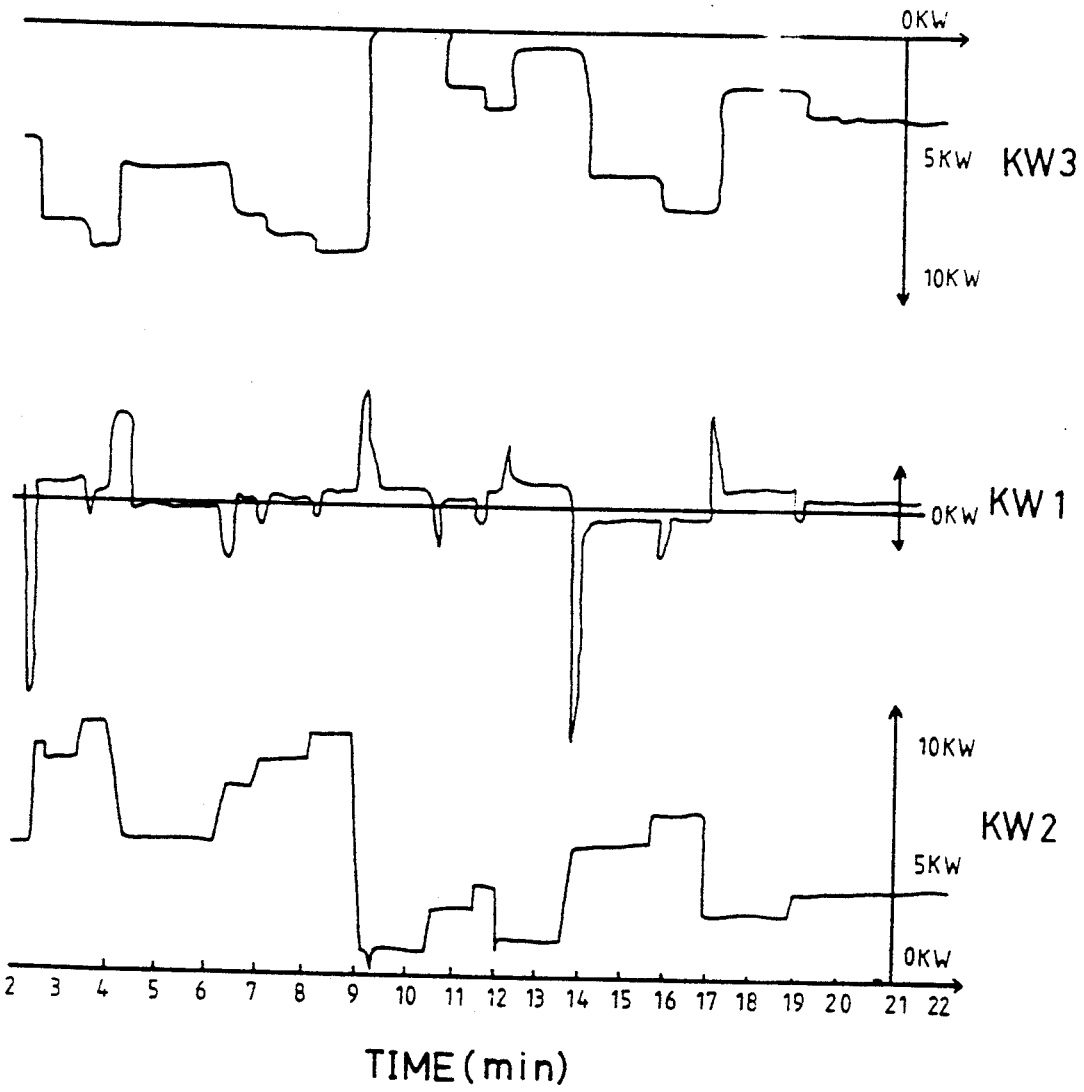
FIG. 7 shows a recorded curve of the effective power of the commercial AC power network, the power output of the biogas generator, and the power consumption of the load in an operation test.

FIG. 7 is a record of the curves of the effective power of the commercial AC power network, KW1, the power output of the biogas generator, KW2, and the power consumption of the load, KW3, in an operation test. It is obvious that less electricity is supplied by or fed into the commercial AC power network.

While the invention has been described by way of example and in terms of several preferred embodiments, it is to be understood that the invention need not be limited to the disclosed embodiment. On the contrary, it is intended to cover various modifications and similar arrangements included within the spirit and scope of the appended claims, the scope of which should be accorded the broadest interpretation so as to encompass all such modifications and similar structures.

What is claimed is:

1. A power regulator for controlling an induction-type generator coupled to a commercial AC power network and a load, the induction-type generator supplying a first output power and the commercial AC power network supplying a second output power, the load consuming an input power, said power regulator comprising:

a power detector adapted to detect a difference between the first output power and the input power, and to generate an indicating signal representative of a difference power drawn from or supplied to the AC power network;

comparing means coupled to said power detector means for comparing said indicating signal with predetermined positive and negative references, said comparing means outputting a positive driving signal when said indicating signal is greater than the positive reference, and outputting a negative driving signal when said indicating signal is smaller than the negative reference; and controlling means coupled between said comparing means and the induction-type generator for controlling the induction-type generator, whereby the first output power is increased in magnitude according to said positive driving signal, and the first output power is decreased in magnitude according to said negative driving signal.

2. The power regulator of claim 1, wherein said controlling means comprises a governor governing a flow of a biogas to an engine driving the induction-type generator.

* * * * *